US006487967B2

(12) United States Patent
König et al.

(10) Patent No.: US 6,487,967 B2
(45) Date of Patent: Dec. 3, 2002

(54) DEVICE FOR CLAMPING THE TRAILING EDGE OF A PRINTING PLATE IN A PLATE CYLINDER OF A ROTARY PRINTING MACHINE

(75) Inventors: Werner König, Mannheim (DE); Rolf Kündgen, Eppelheim (DE); Gerd Merkel, Dielheim (DE); Bernd Sitzmann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/736,101

(22) Filed: Dec. 13, 2000

(65) Prior Publication Data

US 2001/0003957 A1 Jun. 21, 2001

(30) Foreign Application Priority Data

Dec. 13, 1999 (DE) ..... 199 60 073

(51) Int. Cl.[7] ..... B41F 27/12
(52) U.S. Cl. ..... 101/415.1; 101/378
(58) Field of Search ..... 101/415.1, 409, 101/378, 383, 481

(56) References Cited

U.S. PATENT DOCUMENTS 3,858,512 A * 1/1975 Simeth ..... 101/415.1
5,168,810 A * 12/1992 Kojima ..... 101/415.1
5,694,854 A * 12/1997 Becker ..... 101/415.1
5,709,149 A * 1/1998 Weber ..... 101/415.1

* cited by examiner

*Primary Examiner*—Leslie J. Evanisko
(74) *Attorney, Agent, or Firm*—Laurence A. Greenberg; Werner H. Stemer; Gregory L. Mayback

(57) ABSTRACT

A device for clamping the trailing edge of a printing plate in a plate cylinder of a rotary printing machine includes a torsion bar disposed in a cylinder gap formed in the plate cylinder and extending in axial direction thereof, clamping elements affixed to the torsion bar and cooperating with holding elements for clamping the printing plate, and actuators provided on both sides of the plate cylinder for stretching the printing plate in axial direction. The torsion bar is of bipartite construction, and the actuators, respectively, are mounted so as to be displaceable axially independently of one another.

6 Claims, 4 Drawing Sheets

11
28
51
53
54
49
47
56
29
50
48
52

DEVICE FOR CLAMPING THE TRAILING EDGE OF A PRINTING PLATE IN A PLATE CYLINDER OF A ROTARY PRINTING MACHINE

BACKGROUND OF THE INVENTION

Field of the Invention

The invention relates to a device for clamping the trailing edge of a printing plate in a plate cylinder of a rotary printing machine, including a torsion bar disposed in a cylinder gap extending in the longitudinal direction of the plate cylinder, and braced against cheeks of the plate cylinder, clamping elements cooperating with holding elements affixed to the torsion bar, for clamping the printing plate, and an actuator provided on the torsion bar for stretching the printing plate in axial direction, the torsion bar being rotatably mounted in a support bearing at the center of the cylinder.

A conventional embodiment of this type is disclosed in the published German Patent Document DE 42 44 279 A1, wherein a printing plate, when clamped, is adjustable to changes in the printing image by stretching the substrate to be processed. With this known construction, the trailing edge of the printing plate, as viewed in axial direction, can be stretched towards both sides from a support bearing arranged at the center. In addition, in this heretofore known construction, it is possible to stretch only one or the other side, so that in the event of a single-sided application of ink to the printing substrate, a matching or adjusted stretching of the trailing edge of the plate can be performed.

In practice, the problem often occurs that the printing plate has to be compressed small amounts in the end region thereof. This option is not provided in the devices heretofore known in the prior art.

SUMMARY OF THE INVENTION

It is accordingly an object of the invention to provide a device for clamping the trailing edge of a printing plate in a plate cylinder of a rotary printing press with which, in addition to stretching the trailing edge of the printing plate, end compression is also possible.

With the foregoing and other objects in view, there is provided, in accordance with the invention, a device for clamping the trailing edge of a printing plate in a plate cylinder of a rotary printing machine, comprising a torsion bar disposed in a cylinder gap formed in the plate cylinder and extending in axial direction thereof, clamping elements affixed to the torsion bar and cooperating with holding elements for clamping the printing plate, and actuators provided on both sides of the plate cylinder for stretching the printing plate in axial direction, the torsion bar being of bipartite construction, and the actuators, respectively, being mounted so as to be displaceable axially independently of one another.

In accordance with another feature of the invention, each of the actuators is a hollow screw.

In accordance with a further feature of the invention, the clamping device includes a cup spring arranged between each of the actuators, respectively, and the torsion bar.

In accordance with an added feature of the invention, the hollow screw is formed with a through bore for accommodating the torsion bar free of contact therein.

In accordance with an additional feature of the invention, the hollow screw is formed with an external thread cooperating with a threaded bore formed in a cheek of the plate cylinder.

In accordance with yet another feature of the invention, the clamping device includes roller bearings wherein the torsion bar is rotatably and axially adjustably mounted.

In accordance with a concomitant feature of the invention, the torsion bar has a torsionally weak construction, and the clamping elements are individually affixed to the torsion bar.

An advantage of the invention is, in particular, that the trailing edge of the printing plate can be manipulated in many ways. For example, it is possible to stretch or to compress the printing plate in specific regions.

In an advantageous embodiment of the invention, a hollow screw, respectively braced against one of the cylinder cheeks, is provided as an actuator for applying axial actuating forces in both axial directions, and a spring, preferably a cup spring, arranged between the hollow screw and the actuating shaft, eliminates play resulting from production operations from the printing-plate stretching and compressing device.

Other features, which are considered as characteristic for the invention, are set forth in the appended claims.

Although the invention is illustrated and described herein as embodied in a device for clamping the trailing edge of a printing plate in a plate cylinder of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
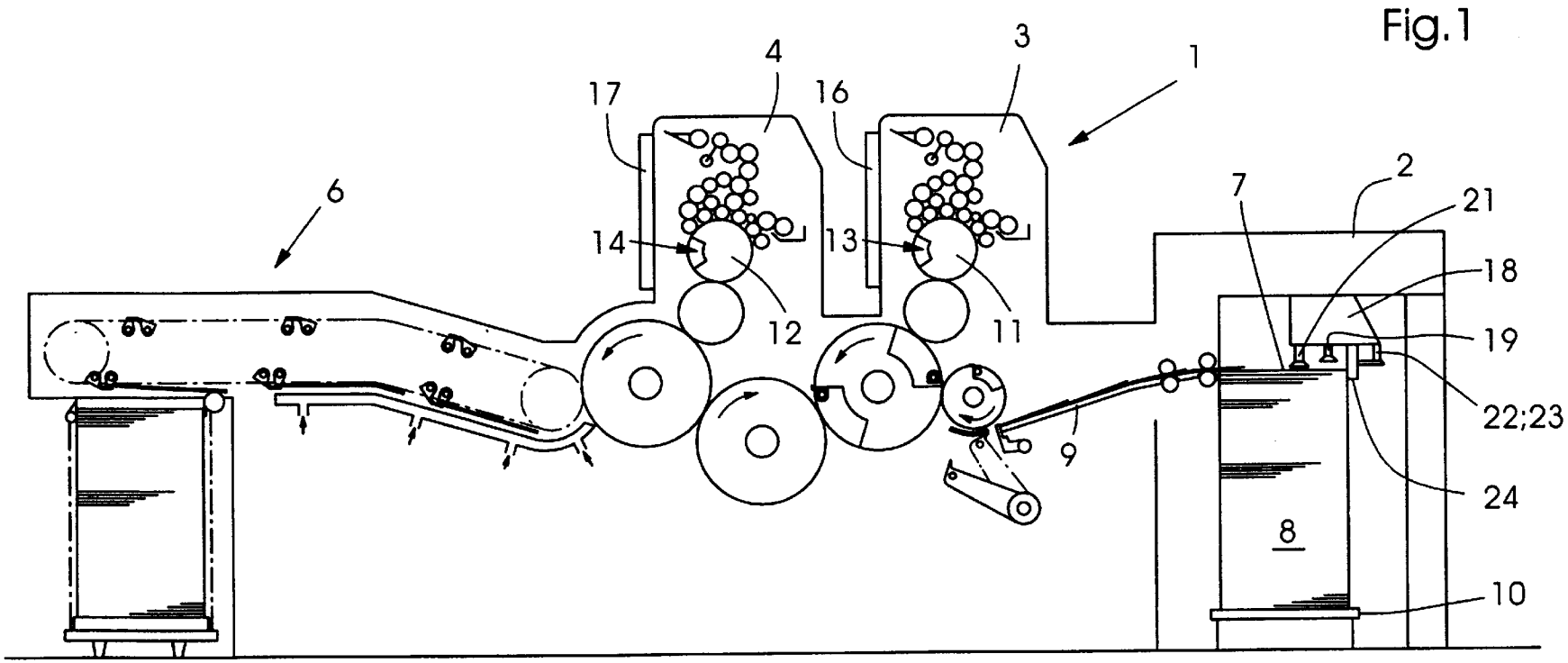
FIG. 1 is a diagrammatic side elevational view of a sheet-fed rotary printing machine with a plate cylinder for incorporating therein the clamping device according to the invention.
Figure 2:
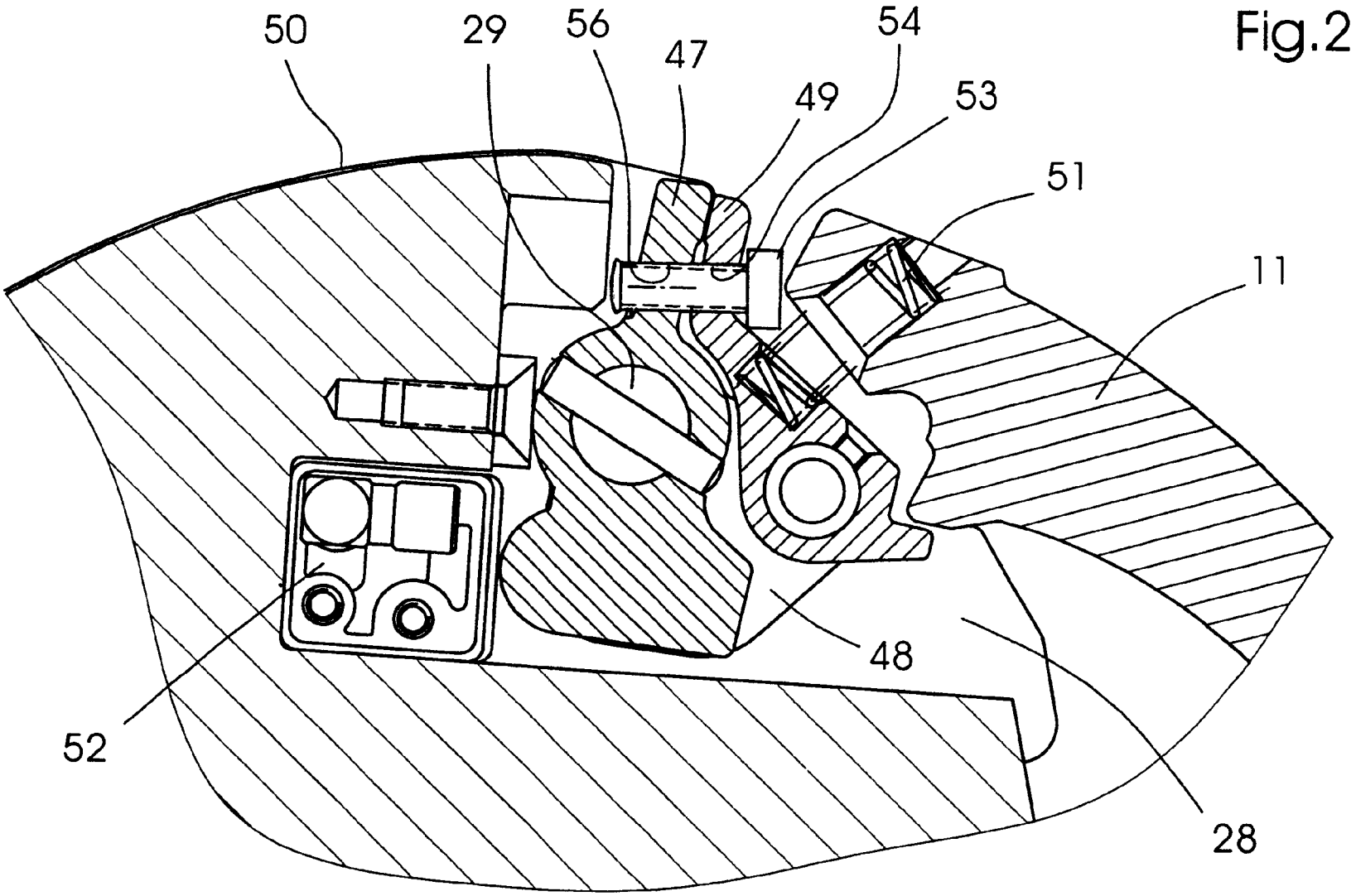
FIG. 2 is an enlarged fragmentary view of FIG. 1 showing, in cross section, the plate cylinder with a cylinder channel thereof, and a clamping/holding element for a printing plate.
Figure 3:
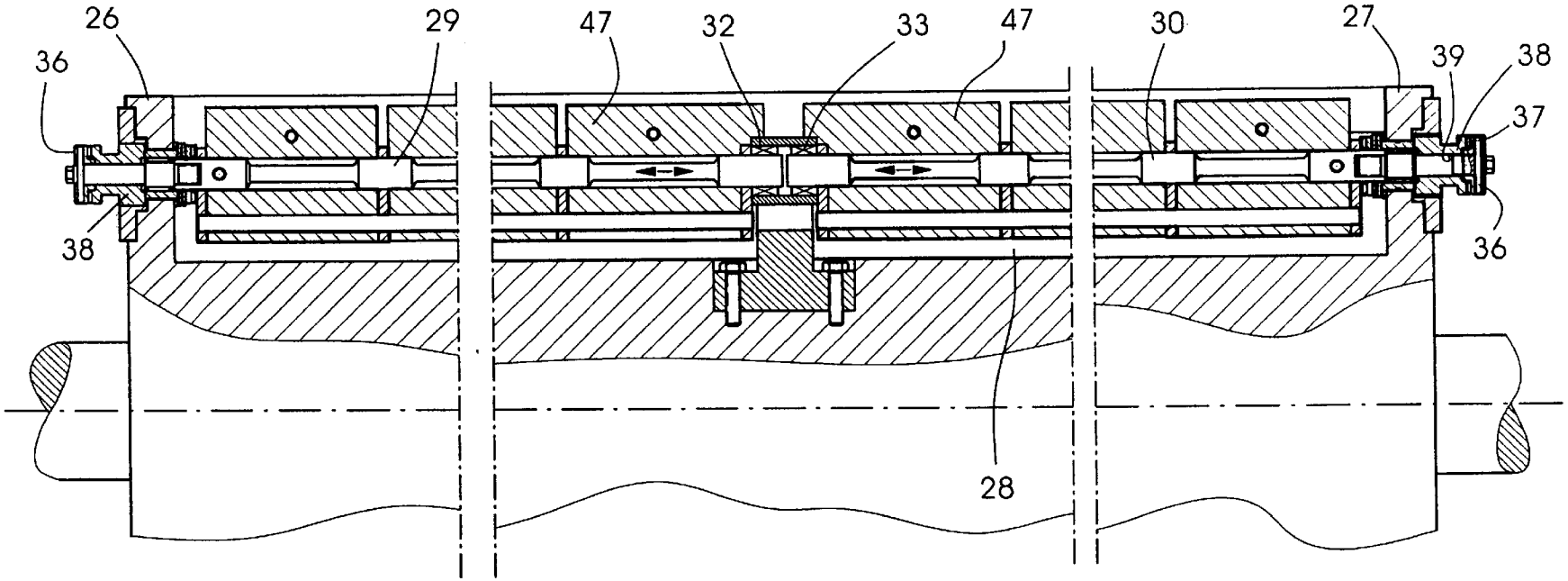
FIG. 3 is a fragmentary longitudinal sectional view of the plate cylinder, showing the cylinder gap therein with a stretching and compressing device according to the invention.
Figure 4:
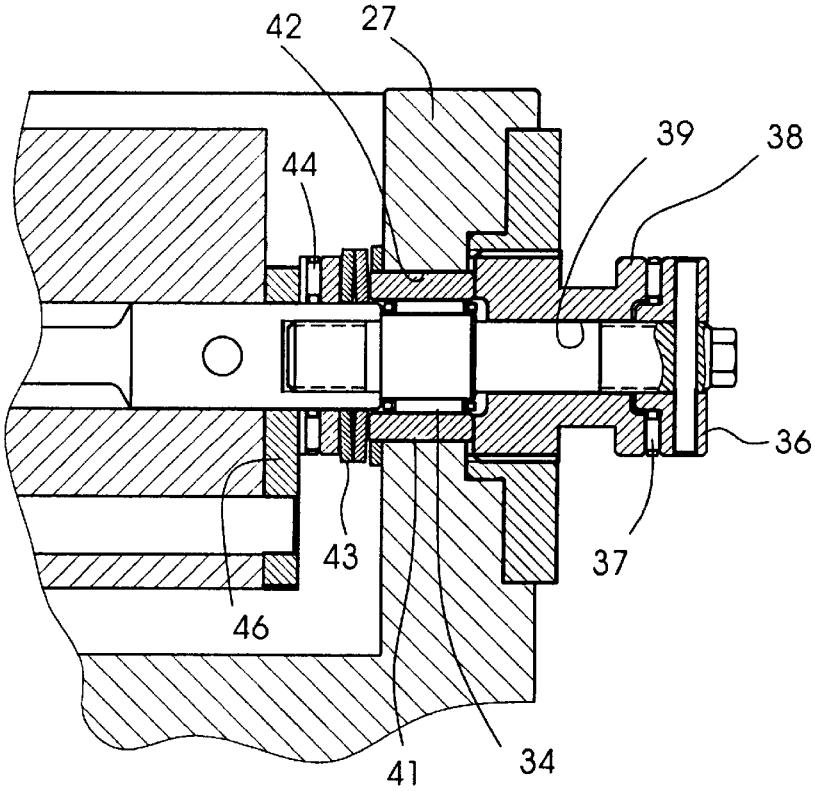
FIG. 4 is an enlarged fragmentary view of FIG. 3, more clearly showing an actuating element for actuating shafts.
Figure 5:
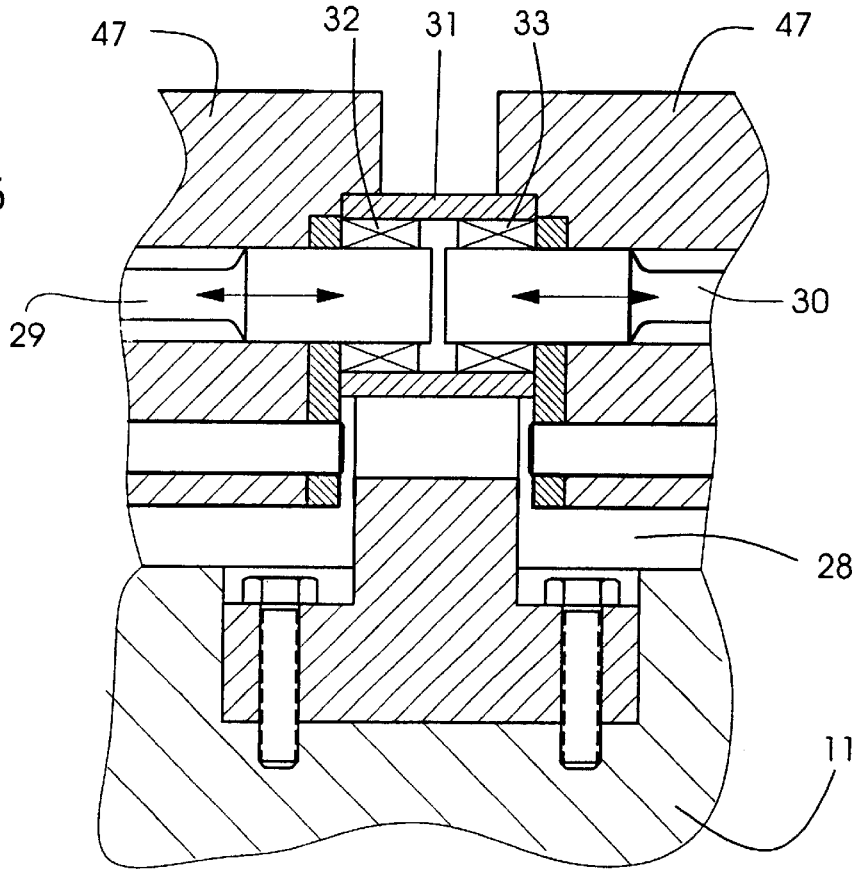
FIG. 5 is an enlarged fragmentary view of FIG. 3, more clearly showing a bearing location for the actuating shafts.

Referring now to the drawings and, first, particularly to FIG. 1 thereof, there is shown therein a rotary printing machine 1, for example, for processing sheets 7, having a feeder 2, at least one printing unit 3, 4 and a delivery 6. The sheets 7 are taken from a sheet pile 8 and are fed, separated or overlapped, over a feed table 9 to the printing units 3 and 4. The latter include, in a conventional way, a respective plate cylinder 11; 12. Each of the plate cylinders 11 and 12 has a device 13, 14 for affixing or fastening flexible printing plates. In addition, to each plate cylinder 11; 12, there is assigned a device 16; 17 for semiautomatic or fully automatic printing-plate changing.

The sheet pile 8 rests on a pile board 10 which can be raised under control. Removal of the sheets 7 takes place from the top of the sheet pile 8 by a so-called suction head 18 which has a number of lifting and dragging suckers 19 and 21, respectively, for separating the sheets 7. Furthermore, blowing or blast devices 22 for loosening the upper layer of sheets, and sensing elements 23 for tracking the sheet pile 8 are provided. In order to align the sheet pile 8, in particular, the top sheets 7 of the sheet pile 8, a number of lateral and rear stops 24 are provided.

The plate cylinders 11 and 12 are identical in design terms, and therefore the invention will be described hereinbelow only with reference to the plate cylinder 11, which has, at the ends thereof, cylinder cheeks or so-called Schmitz or bearer rings 26 and 27-between which a cylinder gap 28 extends. Arranged in the cylinder gap is a two-part torsion bar 29, 30 which are mounted by first ends thereof, respectively, in the cylinder cheeks 26 and 27, and by second ends thereof in a central support 31 in the cylinder gap 28. The central support 31 is in the form of a bushing and carries loose radial bearings 32 and 33, respectively, wherein the second ends of the torsion bars 29 and 30 are supported. The loose radial bearings 32 and 33 therefore permit a rotational movement of the torsion bars 29 and 30, as well as a displacement of the latter in the support 31. The support 31 is screwed firmly to the plate cylinder 11 in the cylinder gap 28. The first ends of the torsion bars 29 and 30 are mounted so that they are pivotable, respectively, by a needle bearing 34 in the cylinder cheeks 26 and 27. At the outer end thereof, the respective torsion bar 29, 30 bears a stop plate 36, which is supported via an axial bearing 37 on an actuating element formed as a hollow screw 38. The hollow screw 38 has a through bore 39 to accommodate the end of the respective actuating shaft 29, 30 without contact, and is formed with an external thread 41, with which the respective hollow screw 38 is screwed into a threaded hole 42 formed in the respective cylinder cheek 26, 27. The hollow screw 38 is supported via a disk spring 43 and a further axial bearing 44 at the end of a stop 46 fixed to the respective actuating shaft 29, 30. In addition to the stop 46, printing-plate clamping pads 47, respectively, distributed at a small distance from and located adjacent one another are firmly seated on the actuating shaft 29, 30. The pads 47, respectively, have a holder 48, whereon a clamping element in the form of a clamping gripper 49 is arranged so that it is pivotable, and cooperates with the printing-plate clamping pad 47. A compression spring 51 braced against or supported on the plate cylinder 11 acts upon the clamping gripper 49 and therefore applies both the clamping force to the clamping gripper 49 and, in the clamping position, a clamping force to the printing-plate clamping pad 47, as well. An actuating element 52 supported on or braced against the plate cylinder 11, for example, in the form of pneumatic bellows, acts upon the printing-plate clamping pad 47, counter to the force of the compression spring 51, and thus releases or unclamps the printing plate 50.

An additional clamping screw 53 is, respectively, arranged in a through bore 54 formed in the clamping gripper 49 and, with the thread thereof, respectively, engages in a threaded bore 56 formed in the printing-plate clamping pad 47.

Through the intermediary of the clamping screws 53, the printing plate 50 is partially specially affixed along the axial length of the printing-plate cylinder 11, in order then to be able to perform a stretching or compression of the printing plate 50 by axial movement of the torsion bar 29; 30 between the partial affixing locations. The part of the printing plate 50 which is clamped in only by the force of the compression spring 51 is therefore able to perform a relative movement, in particular, in the axial direction, with respect to the clamping device. Stretching or compression of the printing plate 50 can therefore be effected in each region located between a printing-plate clamping pad 47 which is arranged on the torsion bar 29, and a printing-plate clamping pad 47 which is arranged on the torsion bar 30.

We claim:

1. A device for clamping a trailing edge of a printing plate in a plate cylinder of a rotary printing machine, comprising a torsion bar adapted to be disposed in a cylinder gap formed in the plate cylinder and extending in axial direction thereof, clamping elements affixed to said torsion bar and being immovably mounted relative to said torsion bar, said clamping elements cooperating with a plurality of holding elements for clamping the printing plate, and actuators provided on both sides of the plate cylinder for stretching the printing plate in an axial direction, said torsion bar being of bipartite construction, and said actuators, respectively, being mounted to said torsion bar so as to be displaceable axially independently of one another.

2. The clamping device according to claim 1, wherein each of said actuators is a hollow screw.

3. The clamping device according to claim 1, including a cup spring arranged between each of said actuators, respectively, and said torsion bar.

4. The clamping device according to claim 2, wherein said hollow screw is formed with a through bore for accommodating the torsion bar free of contact therein.

5. The clamping device according to claim 2, wherein said hollow screw is formed with an external thread adapted to cooperate with a threaded bore formed in a cheek of the plate cylinder.

6. The clamping device according to claim 1, including roller bearings wherein said torsion bar is rotatably and axially adjustably mounted.

* * * * *